US005301811A

United States Patent [19]

Mueller

[11] Patent Number: 5,301,811

[45] Date of Patent: * Apr. 12, 1994

[54] APPARATUS FOR THE SEPARATION OF GRAIN MATERIAL AND THE SORTING OUT OF HEAVY INCLUSIONS FROM GRAIN MATERIAL

[75] Inventor: Roman Mueller, Niederuzwil, Switzerland

[73] Assignee: Gebruder Buhler AG, Uzwil, Switzerland

[ * ] Notice: The portion of the term of this patent subsequent to Feb. 2, 2010 has been disclaimed.

[21] Appl. No.: 951,312

[22] Filed: Sep. 24, 1992

Related U.S. Application Data

[63] Continuation of Ser. No. 392,951, Jul. 21, 1989, abandoned.

[30] Foreign Application Priority Data

Nov. 27, 1987 [CH] Switzerland ..... 04626/87
Mar. 24, 1988 [CH] Switzerland ..... 01110/88

[51] Int. Cl.[5] ..... B07C 5/00

[52] U.S. Cl. ..... 209/44.2; 209/467; 209/498; 209/469; 209/486; 209/502

[58] Field of Search ..... 209/467, 469, 476, 502, 209/497, 498, 486, 466, 468, 508

[56] References Cited

U.S. PATENT DOCUMENTS

| | | | |
|---|---|---|---|
| 255,160 | 3/1882 | Garvin | 209/498 |
| 1,701,624 | 2/1929 | Lide | 209/467 |
| 1,813,303 | 7/1931 | Lide | 209/467 |
| 1,870,042 | 8/1932 | Dorfan | 209/467 X |
| 2,404,414 | 7/1946 | Sutton | 209/467 |
| 2,928,545 | 3/1960 | Forsberg | 209/467 |
| 3,464,553 | 9/1969 | Hancock | 209/467 |
| 4,466,542 | 8/1984 | Oetiker et al. | 209/467 X |
| 4,652,362 | 3/1987 | Mueller | 209/44.2 |

FOREIGN PATENT DOCUMENTS

| | | | |
|---|---|---|---|
| 1361346 | 2/1963 | France | 209/467 |
| 2075525 | 1/1971 | France . | |
| 700215 | 12/1979 | U.S.S.R. | 209/467 |
| 1536905 | 12/1978 | United Kingdom . | |
| 8505050 | 11/1985 | World Int. Prop. O. . | |
| 8804204 | 6/1988 | World Int. Prop. O. . | |

*Primary Examiner*—D. Glenn Dayoan
*Attorney, Agent, or Firm*—McAulay Fisher Nissen Goldberg & Kiel

[57] ABSTRACT

An apparatus for separating grain material and for sorting out heavy inclusions from a product flow, particularly stones from gain material, in which the product flow is fed to an inclined layering table and guided so as to be substantially layered thereon. The layering table being acted upon by air flow and oscillated in such a way that the heavy inclusions lying directly thereon are conveyed up the table and guided away separately at the higher end. The feeding of the product flow is effected by way of a feed duct which opens to into the area of the higher end of the table and feeds the product into the separating zone of the product layers as a flow across the widest possible surface area, the separating zone being located in the area of the higher end of the table. The table has air guides for circulating. On an upper side, a closed hood is arranged and on an end side, a product feed portion is arranged. In the middle thereof, an outlet suction portion coupled to the closed hood is arranged. The inclined layering table as well as the closed hood with the guides for the air outlet portion form an oscillating box which is closed on all sides.

5 Claims, 10 Drawing Sheets

APPARATUS FOR THE SEPARATION OF GRAIN MATERIAL AND THE SORTING OUT OF HEAVY INCLUSIONS FROM GRAIN MATERIAL

This application is a continuation of application Ser. No. 07/392,951, filed Jul. 21, 1989 now abandoned.

BACKGROUND OF THE INVENTION

Field of the Invention

The invention is directed to a process for sorting out heavy inclusions, particularly stones, from grain material in which the material is fed to a layering table and is guided so as to be substantially layered via the layering table, the latter being inclined, acted upon by air flow and oscillated in such a way that the heavy inclusions lying directly on the layering table are conveyed up the table and guided away separately at the higher end of the table

Background Art

In the past, it was attempted in a great many ways to divide a grain mixture into heavy and light grain fractions. A central problem is sorting stones from the grain material. Stones, glass debris, metal parts and other inclusions which substantially deviate in size from the size of a medium kernel are separated by means of sieves. As is known, the outer dimensions of kernels within the same kinds of cereals, such as wheat, barley, rye, oats, spelt, and also other seed materials such as coffee, cocoa beans, broad beans, seeds, flower bulbs, etc., lie within a relatively narrow spectrum of kernel sizes. Whatever is larger than a determined perforation or smaller than a second smaller perforation can easily be separated as another product by means of simple sieves. The difficulty consists in sorting out and separately removing the foreign matter which is approximately the same size as the good grain product.

A water bath was often used previously in that all foreign matter which was heavier than the grain material sank to the bottom of the water bath. In so doing, the gravity effect and buoyancy or upthrust force of the water was made use of. The simultaneous washing effect of the grain product was seen as a chief advantage of this method. This solution has, for some years, been almost completely replaced by so-called dry cleaning because of the washing water which was likewise produced by means of this and, in part, because of the microbial problems connected with it.

In dry cleaning, buoyancy forces basically similar to those utilized in the washing water are produced by means of vibration and a strong air flow across a table surface. The separating methods, according to the generic type, for separating stones, which separating methods have already been suggested by the present Applicant, have usually prevailed in practice over the last two decades, at least where high demands were placed on the separating efficiency (see DE-PS 1 913 707). In this method, a preliminary layering is first produced along a preliminary layering duct. The heavy inclusions sink to the area close to the table. A sliding off of the light layer situated at a distance above the table in the direction of the end which is situated lower by means of the inclination, and to the corresponding outlet for the lighter fraction, respectively, is then effected simultaneously along the table surface. The heavy inclusions lying on the table surface are conveyed in the direction of the table end which is situated higher by means of the oscillating and conveying movement of the table surface, wherein the stones are completely separated in a final separating zone and are guided away via the corresponding outlet. The chief disadvantage of this known solution is the specially required triangular table shape which only permits a limited increase in the product throughput.

Various other solutions were attempted consequently, but without effective practical success. In the majority of cases, it was not possible to achieve the separating quality of the solution mentioned first. Thus, it was attempted in various ways to work with two working tables situated one above the other, wherein the upper table usually has a sieving and layering function, as shown e,g, in DE-OS 25 33 274. In this solution, a substantially perfect de-stoning, i.e. of almost 100%, could be achieved only with additional steps such as special installations, etc.

A grain separator is known from GB-PS 1 536 905, in which an air flow is produced by means of a ventilator arranged under an inclined and perforated chute. The housing, which receives the entire separator, including the ventilator, is rigidly arranged and only the receiving table can be moved.

The classic recycle-air system is disclosed here, in which, however, there are always problems in practice with the prevailing pressures in the respective portions of the housing. In particular, the problem of so-called false air could not be eliminated.

Finally, in the known grain mixture separating processes, particularly heavy material separating processes, the air guidance was problematic, especially as concerned the mutually undisturbed optimal product and air guidance, including product and air feed, with the result that the improvement of the throughput capacity was limited, particularly with good separation.

OBJECT OF THE INVENTION

The invention has the object of providing a new process for sorting out heavy inclusions, particularly a new de-stoning process and an apparatus for implementing this process and a new dry gravity separating system which allows a high throughput.

SUMMARY OF THE INVENTION

This object is met in a process, according to the generic type, in that the product is fed as a flow with the widest possible surface area into the area of the separating zone of the product layers located at the table end which is situated higher.

The first practical attempt with the new inventive idea was already surprising in a twofold sense. First, the separating efficiency was immediately unexpectedly high; secondly, the Inventor selected a feed location which was wrong according to all previous conviction in the technical field. The desired success was achieved nevertheless. Previously, the process was conceived of in two separate steps with respect to space and time, proceeding to some degree from the idea of preliminary separation (see DE-PS 1 913 707). As a first step, a layering was attempted, wherein the layer close to the table was supposed to contain all heavy inclusions, and only as a subsequent step was the preliminary layering, which was guided in a duct, to be fed to the table surface in an undisturbed manner and the stones fed to the outlet for the stones. The effective separation and separate disposal of the stones was effected first in the area of the end of the separating table situated higher. The heavy inclusions were normally supposed to make up only a very small percentage of the grain material, so that the final separating zone correspondingly comprised the smallest dimensions (the tip of a triangle), since only a small portion of the entire product quantity was guided up to that point. If the final separating zone or the table inclination were incorrectly adjusted, wherein too much grain material could reach this point, or if the localized air flow were selected in a disadvantageous manner, either the de-stoning was poor or a large amount of good kernels were separated out with the stones. The final separating zone was then also a location which always had to be specially monitored. The idea of pouring a large quantity of fresh grain material in the stone separating zone on the table, for example, would have been regarded as completely senseless. Any disturbance in this location caused an immediate worsening of the operation of the separating tables.

By departing from all previous conceptions and from the immutable natural laws supposedly derived from them, e.g.

that a preliminary separation is necessary at all;

and that the latter demands time and distance until the separation of the heavy inclusions, or by feeding the product over a large area of the table in the opinion that every little stone is then given the greatest possible opportunity for separation, the Inventor could first free himself and realize in an unencumbered manner the ideas which particularly consist in that the product feed is effected as a product flow having the widest possible surface area;

and this product flow is fed directly into the area of the separating zone located at the upper end of the table.

The layering table should operate as a good layering table in that it is constituted in such a way that the heavy inclusions lying on the bottom are conveyed up the table. In this way, most of the heavy inclusions remain in the area of the separating zone with a product feed at the end of the table which is situated higher. However, should the heavy inclusions be carried along some distance in the downward direction, they wander again toward the top into the final separating zone in a more reliable manner than in all previously known solutions. Now it is only a question of the clean design of the final separating zone and the correct adjustment of the air quantity and table inclination to achieve an optimal operation. The invention makes possible particularly good conditions for a simple practical optimization in that the final separation is effected at the maximum possible width, that is, without unnecessary layering thickness, by means of the creation of a product flow having a wide surface area.

The new invention permits a whole range of additional, particularly advantageous constructions. Thus, a uniform layering flow (heavy up the table, light down the table) is produced, preferably on the layering table, with flow direction reversal in the area of the end of the layering table which is situated higher, and the product flow is fed directly into the area of the flow direction reversal.

The flow direction reversal for the light portions is produced in a manner known per se, wherein air likewise flows through a table part which is continued further toward the top, so that the light portions are lifted from the table surface. The product layer, with the exception of the stones, is simultaneously prevented from wandering further up the table by means of an air flow which is directed to the separating zone and down the table and acts almost in the manner of a blowing or air-blast device (see FIG. 2).

In another particularly preferred embodiment form, the material is first fed to a first, uppermost oscillating table, and at least a first portion of a heavy material fraction, which flows up the table and consists of a mixture of heavy grain product and stones, is guided at the upper end of the first table in such a way that the heavy material fraction is fed from the latter across a wide surface area to the upper end area of a table surface of a second, lower layering table located under the latter, through which table surface the same air flows.

This step allows approximately half the throughput quantity, which now, however, contains almost 100% of all heavy inclusions, to be guided away, as heavy layer, from the upper table surface to the lower table. The actual separation of the heaviest inclusions to be separated is effected in this case on the lower table. In this way, the product throughput can be doubled in a single apparatus with the same air quantity, specifically without the slightest losses with respect to the separating quality.

In another preferred embodiment form of the process, according to the invention, the material on the upper layering table is moved upward with a smaller conveying component than on the lower layering table, and a second portion of the heavy material fraction is fed from the upper layering table to the lower end area and/or to the middle of the lower layering table.

This has the advantage that the de-stoning takes place in two stages which are separated with respect to time and space.

In a particularly preferred manner, the product flow is fed via a guide sheet arranged at a distance above the table surface. The product flow can accordingly be guided over the entire table width of the layering table in an advantageous manner.

In addition, it is suggested that the feeding of the product flow be effected in the direction of the flow direction of the light grain layer (or opposite the flow direction of the heavy grain layer, respectively).

In a particularly preferred embodiment form of the process, according to the invention, an air flow (blow-back flow) is blown to the separating zone in the direction of a flow direction reversal of the heavy grain product wandering up the table in order to separate the heaviest inclusions (stones) from the shaped product.

This has the advantage that a conveying of the light portions or kernels together with the heaviest inclusions on the table in an upward direction is prevented.

In another particularly advantageous design of the process, the blow-back flow is guided between the guide sheet and the layering table. In this way, it is possible, in particular, to guide the air flow in a simple manner so as to enable a separation of the heavy and light particles of product.

In another preferred embodiment form of the process, the layering table, of which there is at least one, is oscillated jointly with a covering assigned to it for a recycle-air operation with separate guides for inlet and outlet air.

This has the advantage that the entire system has a self-cleaning effect. That is, adhering dust particles are continuously shaken off by means of the shaking movement. A time-consuming cleaning can accordingly be dispensed with. Accordingly, it is ensured that the flow paths are not changed with respect to their cross sections by means of adhering particles, so that continuously constant flow conditions can be ensured.

The material is continuously shaken during the feeding of the material in that the individual elements are arranged inside the covering and the covering can participate in the oscillations.

The mist-like spreading of the product across a wide surface area on the layering table, which is essential for the separating process, is obtained in that both the table and product distributing elements are simultaneously shaken. This joint construction of the elements essential for the separating process inside the covering likewise has the advantage that the disadvantageous sealing problems in the prior art can be avoided.

In another particularly preferred embodiment form, the covering, together with the layering table, forms a box which is supported so as to be capable of oscillation, and the box, including the layering table, is jointly oscillated.

Another very advantageous design idea consists in that the product feed is effected as a flow across the widest possible surface area into the area of the separating zone of the product layers which is located at the end of the table situated higher, the air is guided out of the covering at the top in the center and is supplied across a wide surface area in the area of the lower end of the layering table. This has the advantage that the air supply acts from the bottom upon the entire table width right from the beginning. It is likewise possible to achieve an air flow inside the box which is effected virtually without any undesired eddy formation.

By means of the compact, elegant construction and the transmission of the required oscillations to all structural component parts, it is suddenly possible in a simple manner to fasten the covering so as to be sealed, the individual functions being separate from one another.

In another preferred embodiment form of the process, dust matter is cleaned from the recycle air in the area above the central air discharge and the lower air feed. Accordingly, a cleaning of the flowing air can be effected in an advantageous manner at a point in time at which unwanted eddy formations due to discharge elements for the purpose of cleaning can not yet have a disturbing effect on the air flow acting upon the table.

In another preferred embodiment idea, the material is guided on the upper layering table via a trough-shaped recess (stone and product sump), the heavy material fraction falling into the recess is guided to the central base of the lower layering table via base openings of the recess and subsequently via a chute which is inclined in the opposite direction of the upper layering table; on the other hand, the light product fraction flowing over in the flow direction of the trough-shaped recess of the upper layering table is fed to an outlet for light material. In this way, the heavy layer can sink completely into the stone sump permanently and can be discharged directly downward. Therefore, a very high separating efficiency for the heaviest inclusions results and, in addition, a clean separation can be effected with only a minimum extra expenditure.

In a particularly preferred embodiment form, a suction hood, which participates in the oscillation, as well as a stationary platform arranged above the latter, are assigned to the layering table, wherein the product is fed in the stationary platform via an inlet, is guided via flexible sleeves into a distributor box of a feed duct, which distributor box participates in the oscillations with the suction hood, and is poured from the distributor box via a guide sheet in a cascading manner, so that a simultaneously manifold down-flow is produced over the entire width of the layering table.

The invention is further directed to an apparatus for separating and sorting heavy inclusions from a product flow, particularly stones from grain material, with a feed duct for feeding the product flow to an inclined layering table, through which air flows, which layering table can be oscillated, with an oscillating conveying component in the direction of the end of the table situated higher.

The object mentioned previously within the framework of the process is met in an apparatus according to the generic type in that the feed duct opens out into the area of the higher end of the table.

The first test results with the new apparatus were favorable to a particularly surprising degree, since the product throughput could be increased in part above 50% with the same separating efficiency and the same air consumption without greater expenditure with respect to construction being required for the new apparatus.

In a preferred embodiment form of the apparatus, according to the invention, the feed duct opens out over the entire width of the layering table. This has the advantage that it is possible to feed the product to be separated across a wide surface area and on a large scale.

In a particularly preferred embodiment form, the opening of the feed duct comprises a guide sheet arranged at a distance above the layering table. This guide sheet has the advantage that it distributes the fed product over the layering table in a uniform manner, but simultaneously serves as a guide for air flows at its underside.

In another preferred embodiment form, the feed duct comprises a distributor box and a guide sheet which form a cascade for the feed product flow in order to produce a uniform down-flow along the entire width of the layering table.

In a particularly preferred embodiment form, the guide sheet comprises, in the area of its end facing in the flow direction, an overflow edge and base openings in such a way that the main quantity of product flows onto the layering table as product flow having a wide surface area, and the heavy inclusions are released through the base openings. A particularly wide surface area of the product flow is achieved with this overflow edge because, since the trough is filled to the full width prior to this overflow edge, a uniform flow which is fed from the trough then trickles down onto the layering table located below it.

In a preferred embodiment form, a final separating zone for sorting out the stones is arranged between the guide sheet and the table surface of the layering table.

Another breakthrough with respect to greater throughput capacities could first be achieved in that two jointly oscillating layering tables are arranged one directly above the other and the same air flows through them.

The lower layering table preferably has a greater conveying component in the upward direction than the upper layering table, wherein, for this purpose, its surface is rougher than that of the upper layering table. The upper layering table accordingly serves in an advantageous manner as a preliminary layering table. It is likewise advantageous if the upper layering table comprises at least one discharge opening at its higher end which serves as a feed duct for the lower layering table. Thus, a smallest heavy material fraction can be guided directly to the higher end of the lower table.

In particularly preferable manner, the feed duct for the lower layering table extends along the entire width of the upper layering table in order, in turn, to produce a uniform product distribution on the lower layering table.

The two layering tables are advantageously arranged relative to one another in such a way that the upper layering table feeds material to the upper table end of the lower layering table. In this way, it is possible that virtually the entire portion of the material to be separated is fed to the location of the lower table at which the unexpectedly favorable separation is enabled.

In a particularly preferable manner, the layering table, of which there is at least one, is part of a box which oscillates jointly with it and is designed for recycle-air operation.

This has the advantage that not only the layering table, but also the box connected with the latter is simultaneously thoroughly shaken. A self-cleaning effect can accordingly be achieved in such a way that adhering dust particles can be shaken off during the operation of the system.

It is simultaneously possible to design the entire system inside the box without the usual sealing problems, since the system, according to the invention, is sealed toward the outside, so that the air inside can be controlled in a deliberate manner.

If the system inside the box were not tight relative to external air, secondary air would be obtained, which would disturb the entire air guidance system. It is likewise possible in an advantageous manner to introduce air along the entire lower table surface in the lower area of the product table in a broad manner. Therefore, in its entirety, an optimal product feed can be achieved with the possibility of fanning out across a wide surface area accompanied by simultaneous optimal air feed without the product feed and air feed disturbing one another.

In another advantageous embodiment form of the apparatus, the product feed is part of the box. This has the advantage that the product feed oscillates along with the box and, because of this oscillating movement, the material is loosened in a preliminary manner already before impacting on the shaking table, and a so-called mist is formed. This mist, or thin stream, ensures a distribution on the table across a wide surface area. In addition, during a simultaneous cleaning due to the shaking movement, a cleaning of the product feed is to be expected.

In another preferred embodiment form, an air outlet suction space and a recycle-air feed duct which is separate from the latter and opens out in the area of the lower situated end of the layering table, of which there is at least one, are provided inside the box. Accordingly, it is possible to construct the air outlet suction space as well as the recycle-air feed duct on a large scale with respect to their dimensioning in such a way that no sharp narrowing, unwanted eddies or other unwanted flow effects can take place. The entire air flow can be guided through the table inside the box so as to be undisturbed and, particularly in the width of the lower surface of the lower table, can travel through the latter uniformly along the full width.

In another preferred embodiment form of the apparatus, according to the invention, the following are arranged at the upper side of the box: a product inlet at one end side, an air outlet suction connection piece approximately in the center, and an air return line for the recycle-air duct at the opposite end side. Accordingly, it is possible to suction off the recycle air conveyed through the respective layering table centrally accompanied by favorable flow conditions without expecting a disturbance of the flow characteristics by means of the fed product. However, it is possible with the lateral product feed to supply feed material to the center of the layering table to be charged. At the same time, this preferred embodiment example makes it possible to conveniently suction off the air via the center. Sufficient space accordingly remains for the recycle-air feed duct, since the so-called outlets for the material can be constructed so as to be relatively narrow without causing interference in the product guidance. Accordingly, the air feed can proceed right from the beginning in the lower area of the layering table from below in a broad manner, that is, so as to charge the entire width of the table from below.

In another particularly preferred embodiment form, the box is supported in a frame so as to be capable of oscillating, the frame comprising a stationary head part in its upper area, wherein the head part is connected with a recycle-air separator via the air outlet suction connection piece and with the box via flexible sleeves. Due to this compact and elegant construction, sealing problems can only result at the three connection pieces at the surface of the box which are connected with the stationary part of the non-oscillating frame, the head, via flexible sleeves. The seals can be constructed so as to be particularly reliable in operation, since flexible sleeves whose reliability has long been proven can be used for this purpose. By means of the seals, the operating reliability finally leads to a flow configuration inside the box which is free from disturbance.

In a preferred embodiment form, the recycle-air separator is connected with a suction ventilator and with a dust removal line. In this way, the troublesome portion of fine hulls and dust can be removed from the air flow. Moreover, it is advantageous to connect the recycle-air duct with an aspiration connection for fine dust filters. Accordingly, a collection of dust can be prevented in the entire apparatus, and the operating reliability and hygiene can be increased. Because of the recycle-air operation, only a small portion of the entire air quantity need be guided via the fine dust filter.

In another preferred embodiment form, the upper table surface comprises, in its lower area, a trough-shaped recess (stone or product sump) with fall-through openings in the trough base for additional separation of the product flow into a heavy fraction and light fraction.

In addition, a high de-stoning efficiency, specifically a separation of all foreign heavy parts still present in the sieved grain material, can be effected with the invention. Moreover, in an advantageous manner, little air is needed and the process and apparatus are simple and, in particular, have a low sensitivity to fluctuations in throughput.

Some embodiment examples of the invention are explained in further detail in the following.

DESCRIPTION OF THE INVENTION

Figure 1:
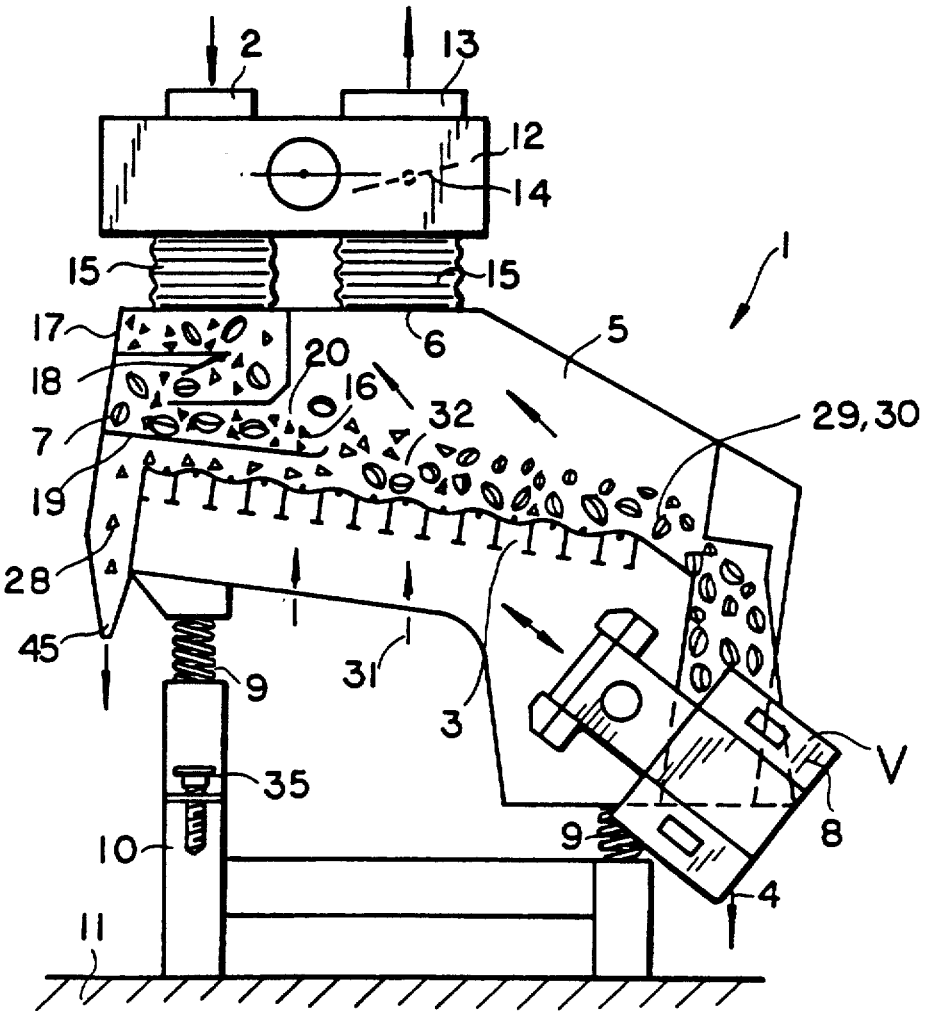
FIG. 1 shows the simplest form of a small table separator for stones.
Figure 2:
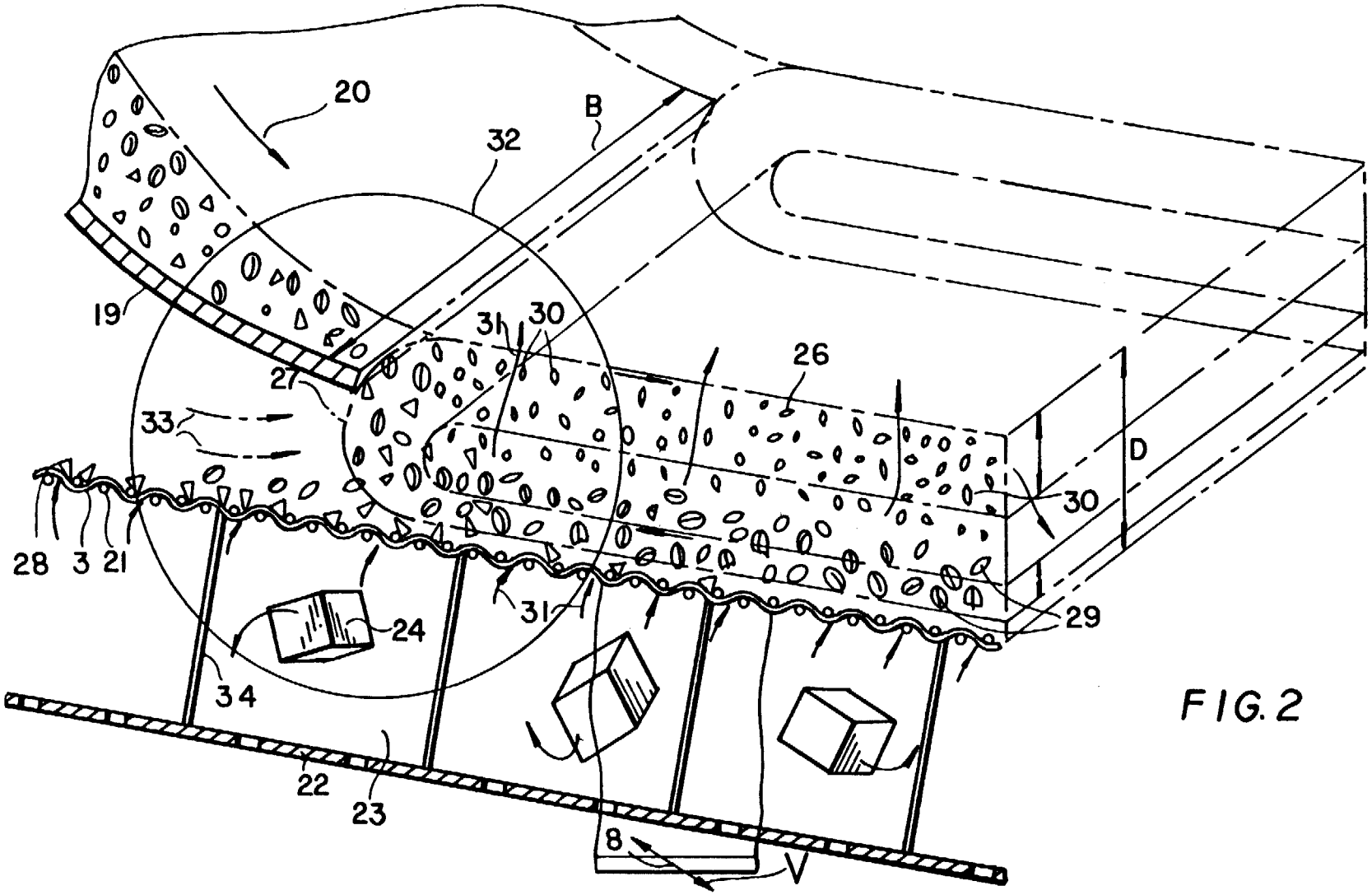
FIG. 2 shows the product feed on the layering table.

FIGS. 1 and 2 are referred to in the following. FIG. 1 shows a basic type for a new de-stoner 1, wherein the fresh grain material is guided to a layering table 3 through an inlet 2 and is guided away from the layering table 3 via an outlet 4 as cleaned grain product. A closed hood 5 which comprises a suction opening 6 is arranged over the layering table 3. Together with the layering table 3, the hood 5 forms an oscillating device 7 which can be oscillated by means of an oscillator 8 with an oscillating component in the direction of the upper end of the layering table 3. The upper end of the layering table 3 is constructed by means of a guide sheet 19 as final separating zone. The entire oscillating unit 7 is supported via spring elements 9 on a frame 10 which is secured so as to be upright on a floor 11. A non-oscillating head part 12, in which the inlet 2 and an air suction line 13 are arranged, is likewise securely connected with the frame 10. In addition, an air quantity adjusting flap 14 for adjusting the air which is aspirated through the entire de-stoner 1 is arranged in the air suction line 13. The connection of the oscillating parts and the oscillating unit 7, respectively, with the head part 12 is effected via flexible sleeves 15 which are arranged downstream of the inlet 2.

As seen in outline, the layering table 3 has a shape which is preferably approximately rectangular. The layering table 3 can be removed for maintenance work at the side of the layering table end which is situated higher. The product transfer point extends along the full width of the table. The width is designated in FIG. 2 by "B:, the layering thickness is designated by "D:. The formation of a product flow 20 across a wide surface area, also called product mist, for the purpose of product feed is effected in two stages. The fresh grain material is guided in a distributor box 17 as part of the oscillating hood 5. The oscillation promotes the uniform, wide distribution of the grain product in the distributor box 17 which, in order to augment this effect, is constructed in a cascading manner so as to widen in a downward direction. A back-up flap 18, which is likewise provided in the distributor box 17, serves the same purpose, so that the grain product is guided, already as a product flow across a wide surface area, directly to the guide sheet 19 extending along the entire table width and then, as uniform, wide product flow 20, to the layering table 3. The spreading of the product flow 20 across a wide surface area is additionally reinforced in that the guide sheet 19 comprises an overflow edge 16 at its free end and is accordingly trough-shaped. For a preliminary separation of heavy material and light material, the trough-shaped guide sheet 19 can also comprise base openings for the passage of the heavy inclusions.

The wide, uniform spreading of the product flow on the layering table 3 is clarified particularly in FIG. 2. The layering is shown in the same Figure in a deliberately overemphasized manner. The layering table 3 comprises a rough mesh grating 21 as product support and is constructed in so-called sandwich construction in a manner known per se, wherein the mesh grating 21 forms the upper side, supported by means of sheet-metal strips 34 which are arranged in the manner of a honeycomb and are held at the bottom by means of a fine perforated sheet 22. Cleaning bodies 24, which keep both the mesh grating 21 and the perforated sheet 22 clean, are arranged in the individual fields 23 between the sheet-metal strips 34. It is also important in this respect that the perforated sheet 22 have an air resistance which is much greater than the air resistance of the mesh grating 21, e.g. in the order of magnitude of 1:10. By means of this step, the air distribution can be kept approximately constant on the entire surface of the layering table 3 regardless of the layering thickness on the mesh grating 21.

The product layering itself substantially consists of three different layers, wherein a lower heavy layer 25 containing the heavy inclusions is conveyed up the table by means of the mechanical impelling oscillating movement. A light layer 26, from which the heavy inclusions have been separated, is not only kept in the loose state but is also suspended at a distance above the mesh grating 21 by means of the directed air flow. Since the layering table 3 is slightly inclined and the upper light layer 26 does not receive any direct conveying momentum directed up the table, but is kept in an oscillating state, this light layer floats toward the side of the table which is situated lower. Moreover, the layering table 3 is adjustable with respect to its inclination by means of an adjusting device 35. A third layering 27 consists of the actual heavy inclusions, mostly only individual particles, individual foreign bodies, stones 28, etc. Product, heavy kernels 29 and light parts, e.g. half-kernels, hull parts 30, are shown in the form approximately corresponding to them. The heavy product with the stones 28 sinks immediately to the oscillating table surface 7 and moves up the table by means of the oscillation and the rough table surface constructed as mesh grating 21.

It is important for the described function that the air flow be correctly guided. A suction-air flow, whose flow direction is indicated by arrows 31, flows through the entire layering table surface uniformly from the bottom to the top. This air flow 31 puts the grain product into a very fluidized state. Since only the heaviest parts, i.e. the stones 28, are separated out on the higher end of the table and are to be conveyed from there into a stone lock 45, a corresponding blow-back flow 33 is formed which prevents light parts or kernels with the heaviest inclusions from being conveyed upward along with them. The blow-back flow is preferably formed under the guide sheet 19. If the guide sheet 19 is securely connected with the hood wall, the air guided into the slot between the guide sheet and layering table can only deflect in direction 33.

Thus, the product, with the exception of the stones 28 located therein, is prevented from wandering further upward prior to the final separating zone by means of the air flow. The stones 28 can continue their movement toward the higher end of the table.

The same blow-back flow 33 causes a flow front or flow direction reversal 32 which clearly occurs in practice. At the point of the flow direction reversal 32, the grain product 29, from which the stones 28 have been separated, is lifted from the table surface by means of the strong air flow 31, 33 and now flows freely down the table together with all light product with the upper lifted light layer 26. The lightest fraction is immediately discharged in the outlet 4; a medium grain fraction, particularly borderline kernels, can possibly repeat a circular migrating movement up and down the table several times.

In FIGS. 1 and 2, the product flow 20 is fed directly into the zone of the flow direction reversal 32. The flow direction reversal 32 is produced from the three forces consisting of the mechanical conveying action up the table, the floating of the upper layer 26 down the table, and the blow-back flow 33.

Figure 3:
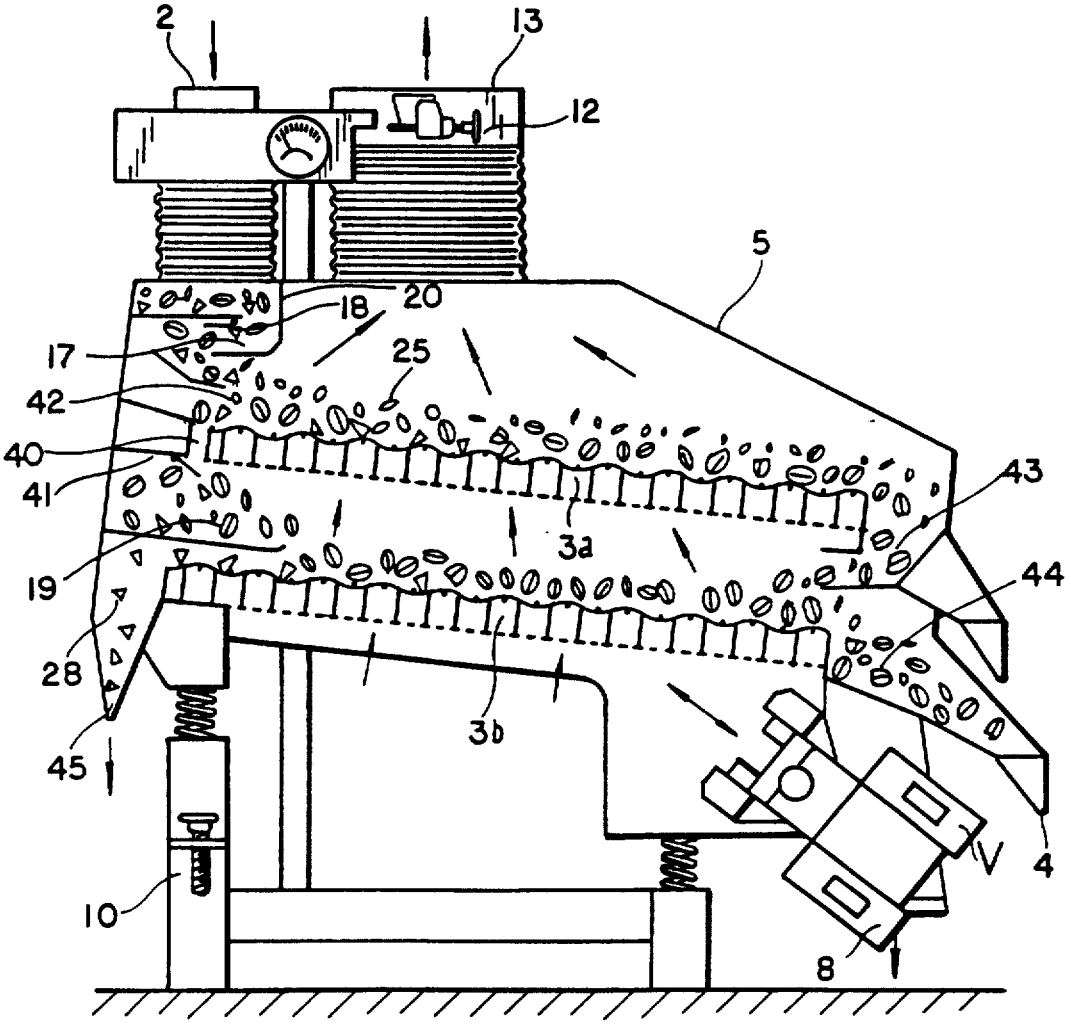
FIG. 3 shows the same solution arrangement as FIG. 1, but with two table surfaces, particularly for a large product throughput.

The main difference between FIG. 3 and FIG. 1 in terms of construction consists in that two layering tables, an upper layering table 3*a* and a lower layering table 35, are used in FIG. 3. The two layering tables 3*a* and 3*b* have basically the same construction, e.g. as in FIG. 2. The blow-back flow 33 is absent, in principle, in the upper layering table 3*a*, so that not only the heaviest inclusions, but the entire heavy layer 25 is moved down the table and can fall onto the guide sheet 19 through an outlet duct 40 via a deflecting plate 41. After the guide sheet 19, the manner of operation of the layering table 3*b* is identical to that of the layering table 3 of FIGS. 1 and 2, respectively.

In order to prevent the newly fed product flow 20 from the distributor box 17 from being directly mixed with the heavy layer 25, a guide plate 42 is arranged between the distributor box 17 and the layering table 3*a* at the uppermost point.

The product flow flowing down is released directly into an outlet duct 44 of the lower layering table 3*b* via a product lock 43. The two product flows of the two layering tables 3*a* and 3*b* from which the heaviest inclusions have been separated are then guided together again in outlet 4. All of the heaviest inclusions, such as stones 28, etc., are first separated off from the upper layering table 3*a* together with the heavy layer 25. The actual separating and separate disposal of the stones 28 first takes place on the lower layering table 3*b* via the stone lock 45. The de-stoning takes place in this instance in two separate stages with respect to time and space. That is, first a concentrate formation of all heavy material, e.g. 30% to 60% of the entire product throughput, is effected on the upper layering table 3*a*, and the stones and other heaviest inclusions are separated out and guided away separately first from the reduced product throughput.

Figure 4:
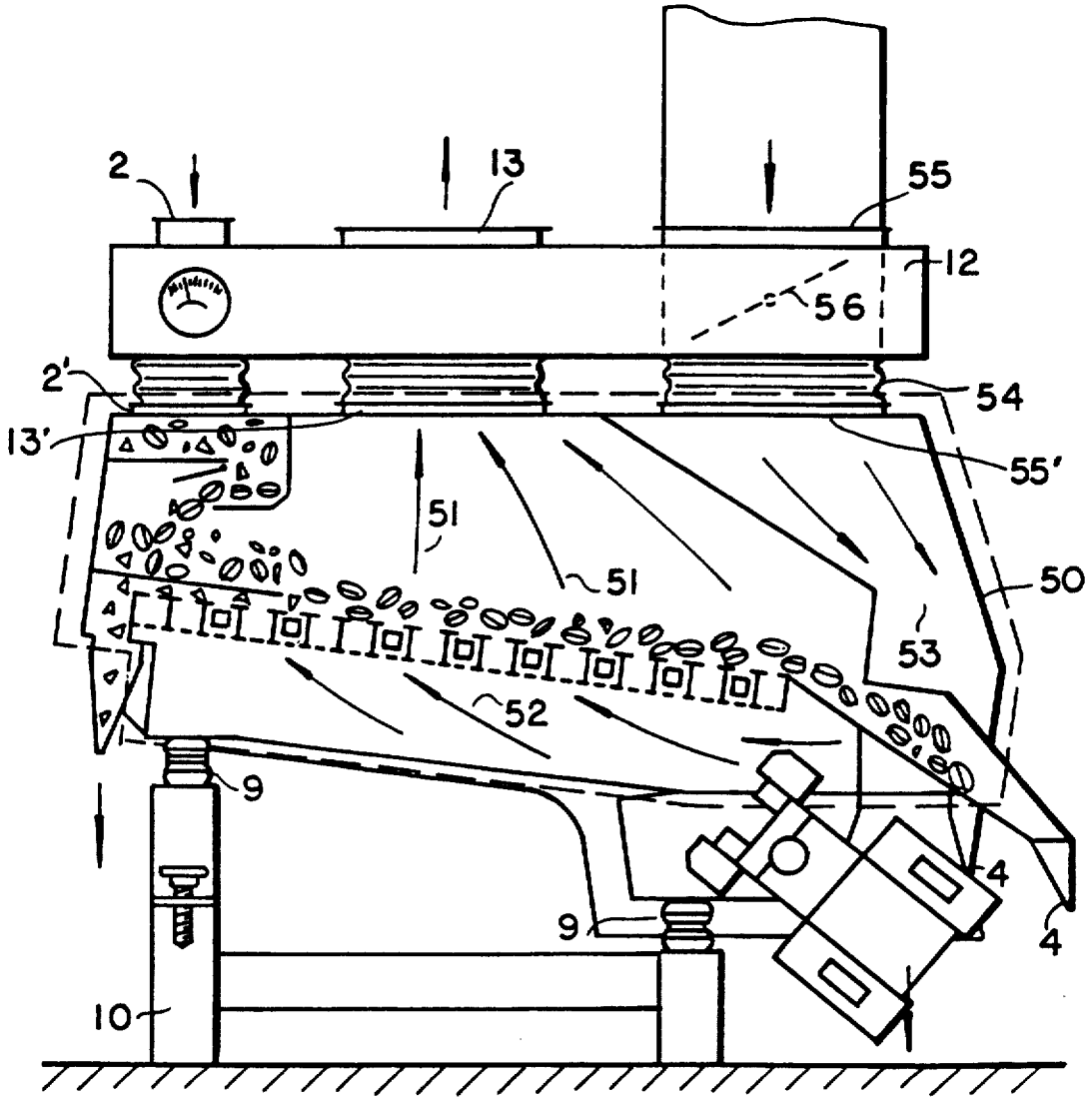
FIG. 4 shows a solution according to FIG. 1, but with a recycle-air duct.
Figure 5:
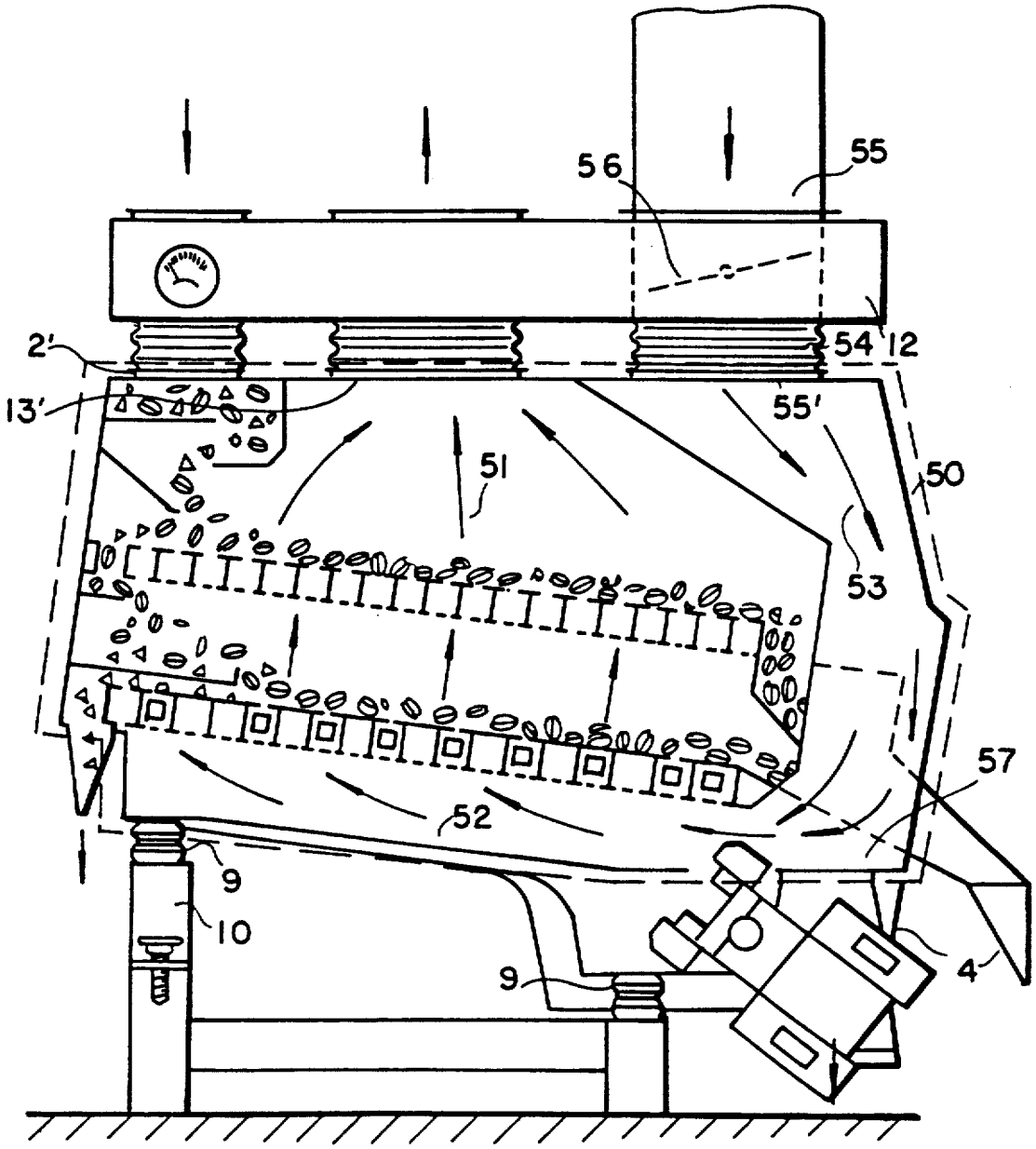
FIG. 5 shows a solution according to FIG. 3, but with a recycle-air duct.

With respect to the product guidance, FIG. 4 is identical to FIG. 1, and FIG. 5 corresponds to FIG. 3. The solution idea of FIG. 4 and FIG. 5, however, additionally contains a box 50 which is closed on all sides and is divided into an upper outlet suction space 51 and a lower inlet suction space 52 by means of the layering table or tables, respectively. A recycle-air duct or air return guide 53, which is connected with an air return line 55 via a flexible tube 54 and an air return connection piece 55', is located laterally at the lower end of the layering table or tables, respectively. An air quantity throttle 56 is arranged in the air return line 55. In FIGS. 4 and 5, the box 50 itself is supported on the stationary frame 10 via spring elements 9. A product inlet or feld connection piece 2' adjoining the product inlet 2 is arranged at the upper side of the box 50 at one end side; an air outlet suction connection piece 13' connected with the air outlet suction line 13 is arranged approximately in the center; and an air return connection piece 55' connected with the air return line 55 is arranged at the opposite end side. The aforementioned connection pieces 2', 13', 55' are connected via flexible sleeves 15, 54 at the non-oscillating or stationary head part 12 on the one side and with the box 50 on the other side in order to share in its movement in this way. In the double machine in FIG. 5, two outlets 4 are arranged as tubular product ducts 57 on both sides (vertically relative to the drawing plane), so that the remaining space between the two product ducts 57 remains for the recycle-air duct 53. The box 50 is enclosed by a dashed line in FIGS. 4 and 5 for improved clarity.

Figure 6:
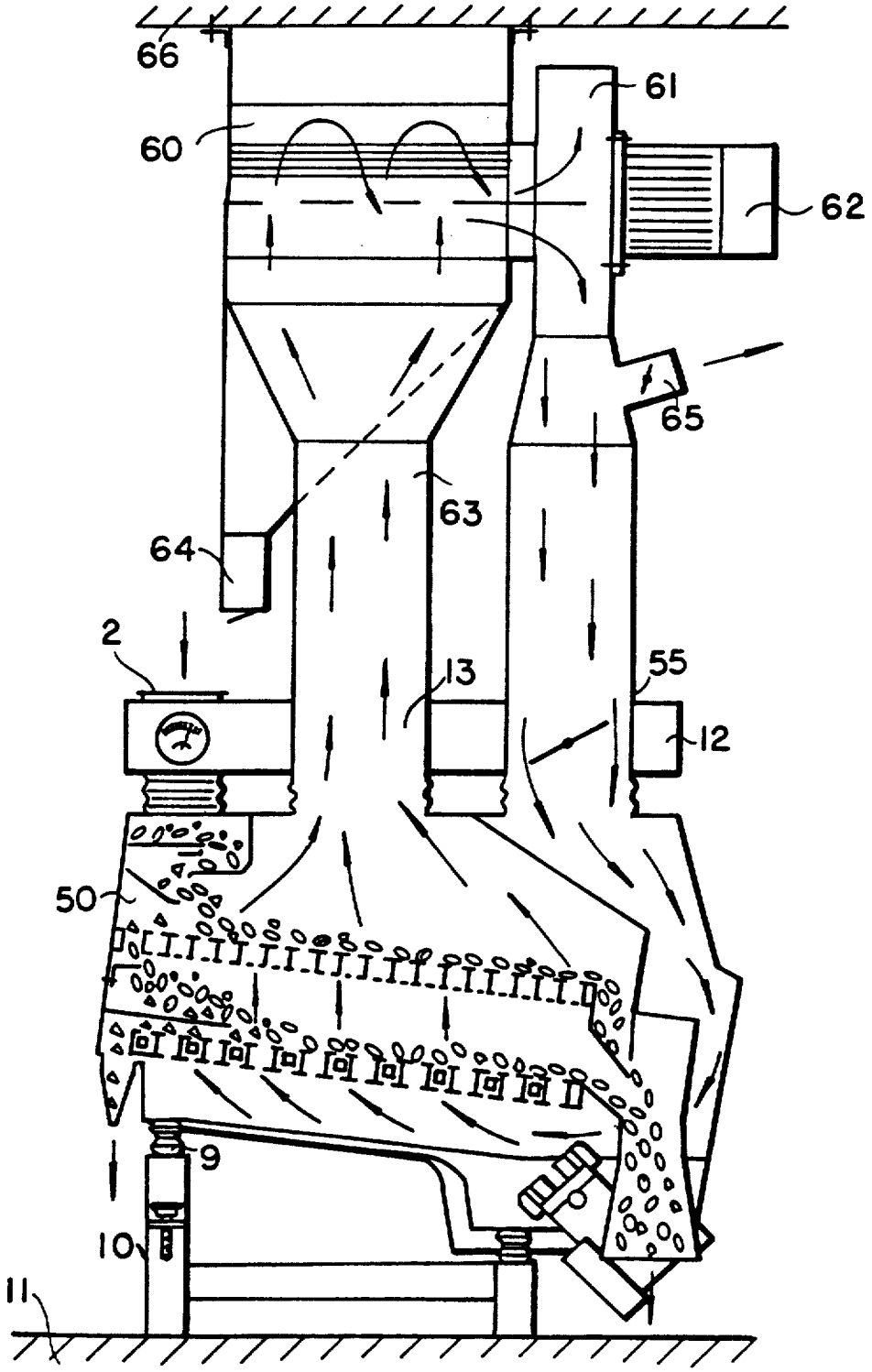
FIG. 6 shows FIG. 5 with recycle-air separator.

By way of addition to FIGS. 4 and 5, a recycle-air separator 60 with suction ventilator 61 and motor drive 62 is shown additionally in FIG. 6. The air outlet suction connection piece 13 leads directly into the recycle-air separator 60, wherein the substantial and bothersome portion of fine hulls and dust is removed from the air flow via a dust removal line 64.

In most cases in which recycle air is used, an air cleaning is advantageous, since a collection of dust can accordingly be effectively prevented in the entire apparatus and the operating reliability and hygiene can be increased. The recycle-air operation has the great advantage that only a minimum quantity of air, e.g. 10% of the circulating air quantity, need be guided via fine dust filters. For this purpose, an aspiration connection 65 is provided. The recycle-air separator 60 can be fastened with the ventilator directly to the ceiling 55.

Figure 7:
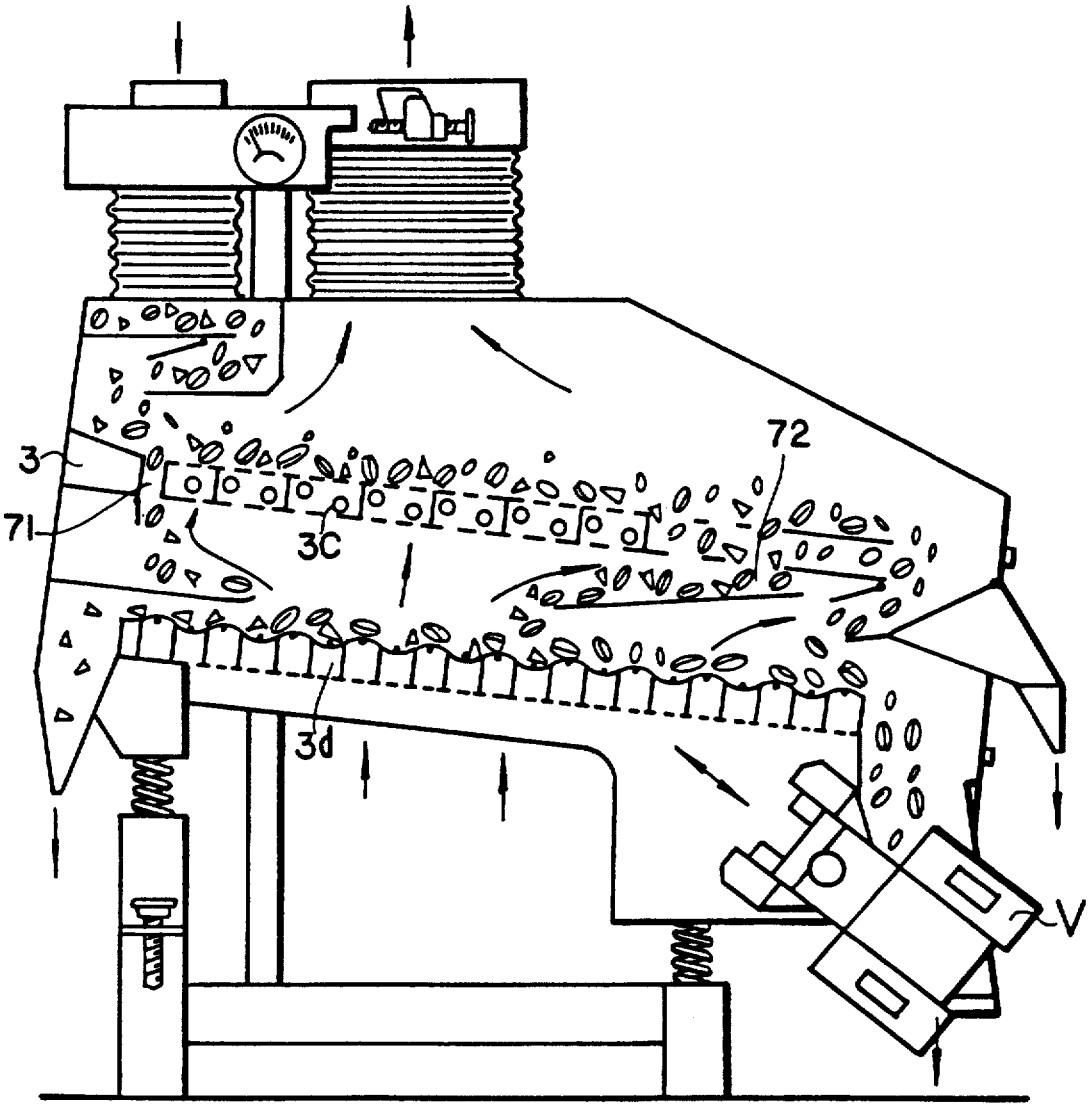
FIG. 7 is a solution similar to FIG. 3 with additional formation of two heavy fractions in addition to de-stoning.

FIG. 7 comprises a basic difference relative to FIG. 3 to the extent that in FIG. 7 only a small part of the product throughput is conveyed from the upper layering table 3*c* at the highest point through a series of larger holes 71 along the entire width of the table down to the upper zone of the flow direction reversal of the lower layering table 3*d*. In the area of the lower table end, the main quantity of heavy material is guided approximately to the center of the lower layering table 3*d* via a chute 72, again along the entire table width. Many series of measurements have shown that in this solution the large portion of stones is nevertheless conveyed directly to the lower layering table 3*d* through the holes 71. In the solutions according to FIGS. 7 and 8, it is important that the upper layering table has a surface which is only less rough than the lower layering table 3*d*, as is shown in FIG. 9, in that the upper layering table 3*c* is formed from a perforated sheet and the lower layering table 3*d* is formed from a mesh grating.

Figure 8:
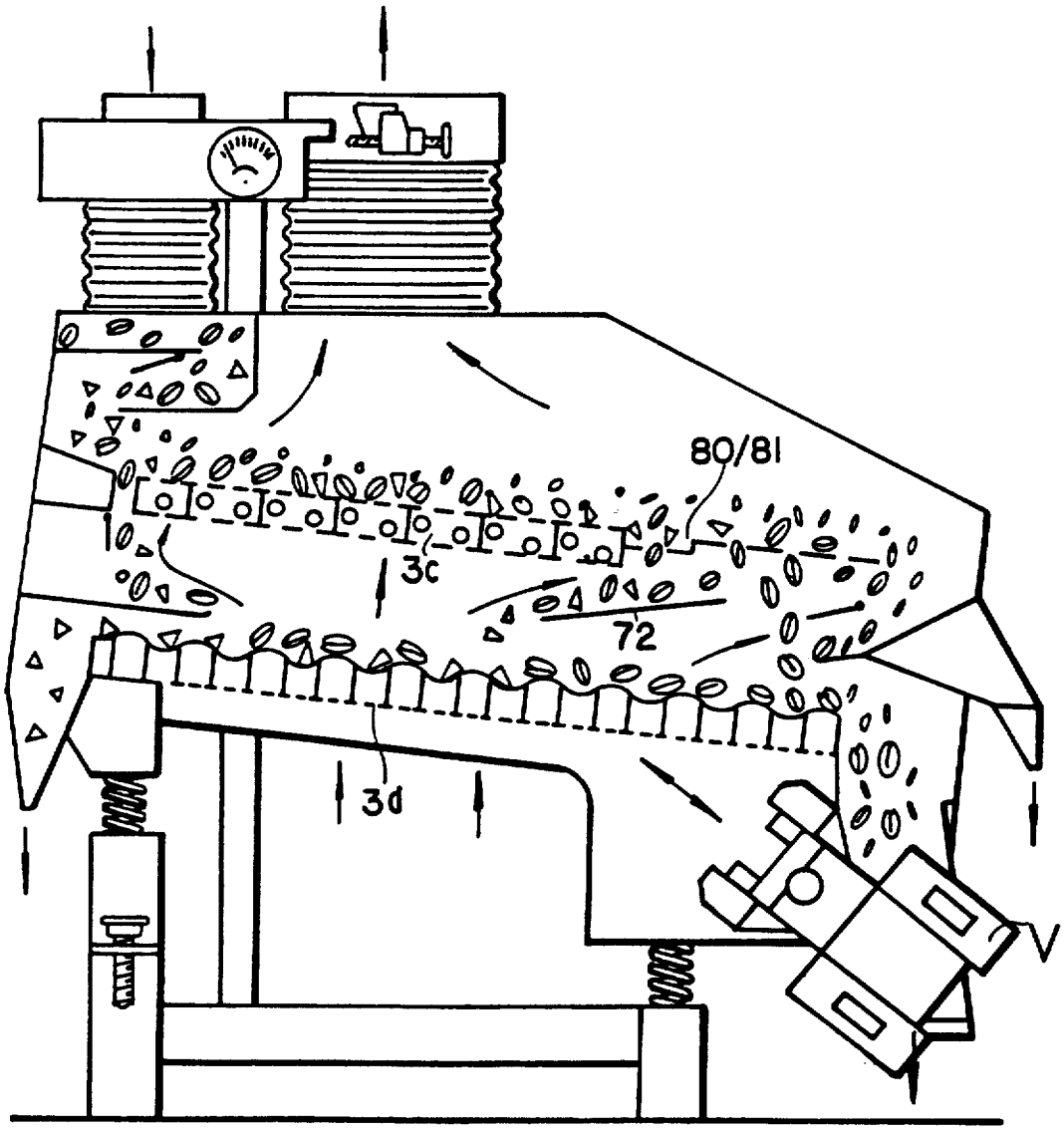
FIG. 8 is a variant of the construction in FIG. 7.
Figure 9:
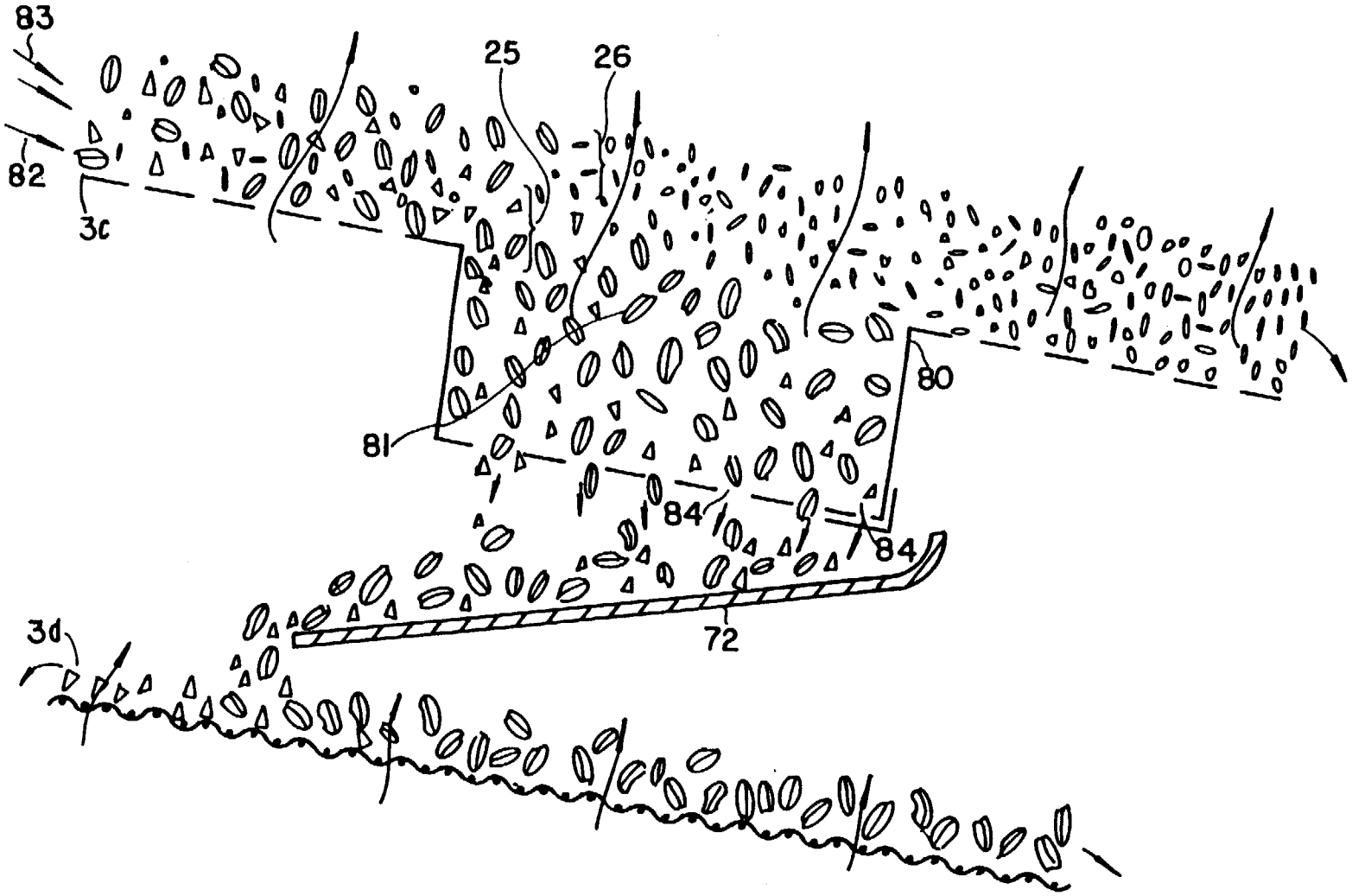
FIG. 9 shows a stone sump on the layering table surface.

A particularly interesting and unique idea is shown in FIGS. 8 and 9; namely, the use of a stone sump 80 in the area of the upper layering table 3*c*. This works as follows: The stone sump 80 consists of a trough-like recess 81 which extends along the entire width of the layering table 3*c*. Similar to FIG. 2, two different layers, namely the heavy layer 25 and the light layer 26, from which heavy inclusions have been separated, are also formed in FIGS. 8 and 9.

Since the surface of the upper layering table 13 has only a slight roughness, no actual upward flow occurs; at least, the entire heavy layer 25 cannot be moved upward. On the contrary, the lower heavy layer 25 flows down the table in a sharply delayed manner as is designated by the single arrow 82. On the other hand, the light layer 26 flows down the table at great speed (double arrow 83). The heavy layer now sinks compulsorily into the stone sump 80 once it has reached the area of the recess 81. At its base, the stone sump 80 comprises a quantity of fall-through openings 84 through which a portion of the product, together with the stones, is discharged on the chute 72 located beneath it and on the lower layering table **3*d*, respectively, in a continuous manner. When the quantity of effective fall-through openings 84 is correctly adapted to the quantity flow of the heavy layer, the light layer and heavy layers can be separated from one another in such a way that the heavy layer 25 sinks completely into the stone sump 80** permanently and is discharged directly downward. Two great advantages result from this:

1. A very high separating efficiency results in this way for the heaviest inclusions (stones, etc.);
2. With only a minimum or extra expenditure, separation into a clean heavy fraction (good kernels) and the rest into a light product fraction (hulls, shriveled and broken kernels) can be effected in addition to the separation of the heaviest inclusions.

Accordingly, it is possible to carry out the separation into the different basic fractions (stones, etc., heavy, light fractions) in a single apparatus and with very high quality.

Figure 10:
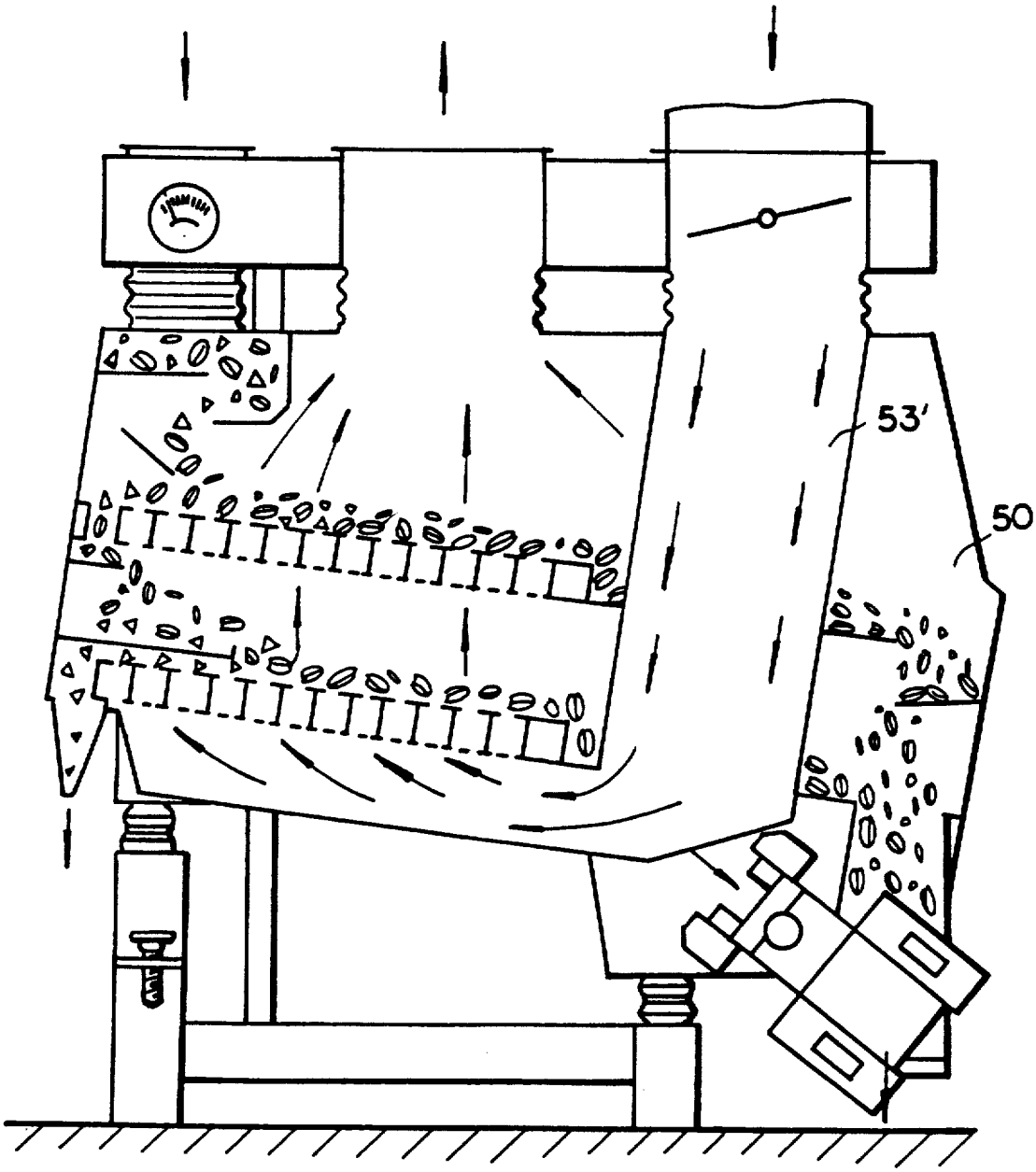
FIG. 10 shows the apparatus as in FIGS. 3, 7 and 8 with recycle-air duct guided through the box.

Finally, FIG. 10 shows an apparatus which functions according to the same principles as the apparatuses according to FIGS. 3, 7 and 8. For this reason, a repetition of the description of the same structural component parts in this place is unnecessary. The apparatus according to FIG. 10 differs from the apparatuses described above only in that a recycle-air duct 53' is arranged separately in the box 50, and its influence on flow characteristics of the air in the box can be prevented.

While the foregoing description and drawings represent the preferred embodiments of the present invention, it will be obvious to those skilled in the art that various changes and modifications may be made therein without departing from the true spirit and scope of the present invention.

What is claimed is:

1. In an apparatus for the separation of grain material, and for the sorting of heavy inclusions therefrom by the use of a through flowing air stream and having an inclined layering table having a higher and lower end which can be oscillated, said table having air guides for circulating air and wherein, on an upper side, a closed hood is arranged, on an end side, a product feed portion is arranged, and in about the middle thereof, an outlet suction portion coupled to said closed hood is arranged, the improvement comprising: that the inclined layering table as well as said closed hood with said guides for the air outlet suction portion form an oscillating box which is closed on all sides and that said guides include an air return guide which provides air flow in the vicinity of the lower end of the inclined layering table and wherein the box is oscillatably arranged on a frame that has a stationary head piece in an upper region.

2. The apparatus of claim 1 wherein, in an upper half of the stationary head piece, a circulating air separator is arranged and wherein the circulating air separator is connected to a fan.

3. The apparatus of claim 2 wherein the oscillating box includes top-to-bottom arranged, spreading, cascade-type distributor box portions, one of said box portions being arranged in the region of the higher table end.

4. Apparatus as in claim 1 wherein the box is arranged as two inclined layering tables one above the other wherein the circulation of both inclined tables streams flow through from bottom to top and wherein a product discharge opening is arranged for the delivery of part of the product of the upper table to the lower table.

5. Apparatus as in claim 1 wherein the air return guide is coupling with an aspiration connection for a fine dust filter.

* * * * *